US008213821B2

(12) United States Patent
Young et al.

(10) Patent No.: US 8,213,821 B2
(45) Date of Patent: Jul. 3, 2012

(54) ENGINE SYNCHRONIZATION WITH A SMALL DELTA TIME BETWEEN ENGINES

(75) Inventors: Timothy J. Young, Williamson, NY (US); David J. Fuest, Warsaw, NY (US); Ronald W. Stephens, Lima, NY (US); Donald J. Lewandoski, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 414 days.

(21) Appl. No.: 12/470,724

(22) Filed: May 22, 2009

(65) Prior Publication Data

US 2010/0296829 A1 Nov. 25, 2010

(51) Int. Cl.
*G03G 21/14* (2006.01)

(52) U.S. Cl. ..... 399/78

(58) Field of Classification Search ..... 399/76, 399/78, 167, 364, 384, 75
See application file for complete search history.

(56) References Cited

U.S. PATENT DOCUMENTS

| | | | | |
|---|---|---|---|---|
| 6,144,024 | A | 11/2000 | Rushing | |
| 6,222,176 | B1 | 4/2001 | Rushing et al. | |
| 6,225,618 | B1 | 5/2001 | Rushing et al. | |
| 6,229,972 | B1 | 5/2001 | Rushing | |
| 6,331,832 | B1 | 12/2001 | Rushing | |
| 6,567,171 | B1 | 5/2003 | Rushing | |
| 6,671,052 | B1 | 12/2003 | Rushing | |
| 6,791,485 | B1 | 9/2004 | Rushing | |
| 6,810,799 | B2 * | 11/2004 | Schultheis et al. | 101/216 |
| 7,245,856 | B2 | 7/2007 | Furst et al. | |
| 7,366,444 | B2 * | 4/2008 | Takane | 399/167 |
| 8,000,645 | B2 * | 8/2011 | Dobbertin et al. | 399/364 |
| 2009/0290895 | A1 * | 11/2009 | Young et al. | 399/75 |
| 2009/0290896 | A1 * | 11/2009 | Young et al. | 399/75 |
| 2010/0296108 | A1 * | 11/2010 | Dobbertin et al. | 358/1.5 |
| 2010/0296117 | A1 * | 11/2010 | Dobbertin et al. | 358/1.15 |
| 2011/0164894 | A1 * | 7/2011 | Dobbertin et al. | 399/85 |

FOREIGN PATENT DOCUMENTS

JP 2000214743 A * 8/2000

* cited by examiner

*Primary Examiner* — Robert Beatty
(74) *Attorney, Agent, or Firm* — Donna P. Suchy

(57) ABSTRACT

A method of synchronizing the timing of a plurality of physically coupled print engines using a small delta time increment. According to the first mode of practice, the second electrophotographic module, designated as E2, is started at a slower operating speed than its normal run speed. The PI control algorithm that controls the motor speed will then allow the speed of E2 to reach its nominal speed.

18 Claims, 7 Drawing Sheets

ENGINE SYNCHRONIZATION WITH A SMALL DELTA TIME BETWEEN ENGINES

FIELD OF THE INVENTION

This invention relates to a printing system comprising a plurality of coupled electrophotographic print modules. More specifically, it relates to a method of controlling the timing of coupled electrophotographic print engines to prevent receiver sheets from buckling.

BACKGROUND OF THE INVENTION

In typical commercial reproduction apparatus (electrographic copier/duplicators, printers, or the like), a latent image charge pattern is formed on a primary imaging member (PIM) such as a photoreceptor used in an electrophotographic printing apparatus. While the latent image can be formed on a dielectric PIM by depositing charge directly corresponding to the latent image, it is more common to first uniformly charge a photoreceptive PIM member. The latent image is then formed by area-wise exposing the PIM in a manner corresponding to the image to be printed. The latent image is rendered visible by bringing the primary imaging member into close proximity to a development station. A typical development station may include a cylindrical magnetic core and a coaxial nonmagnetic shell. In addition, a sump may be present containing developer which includes marking particles, typically including a colorant such as a pigment, a thermoplastic binder, one or more charge control agents, and flow and transfer aids such as submicrometer particles adhered to the surface of the marking particles. The submicrometer particles typically include silica, titania, various lattices, etc. The developer also typically includes magnetic carrier particles such as ferrite particles that tribocharge the marking particles and transport the marking particles into close proximity to the PIM, thereby allowing the marking particles to be attracted to the electrostatic charge pattern corresponding to the latent image on the PIM, thereby rendering the latent image into a visible image.

The shell of the development station is typically electrically conducting and can be electrically biased so as to establish a desired difference of potential between the shell and the PIM. This, together with the electrical charge on the marking particles, determines the maximum density of the developed print for a given type of marking particle.

The image developed onto the PIM member is then transferred to a suitable receiver such as paper or other substrate. This is generally accomplished by pressing the receiver into contact with the PIM member while applying a potential difference (voltage) to urge the marking particles towards the receiver. Alternatively, the image can be transferred from the primary imaging member to a transfer intermediate member (TIM) and then from the TIM to the receiver.

The image is then fixed to the receiver by fusing, typically accomplished by subjecting the image bearing receiver to a combination of heat and pressure. The PIM and TIM, if used, are cleaned and made ready for the formation of another print.

A printing engine generally is designed to generate a specific number of prints per minute. For example, a printer may be able to generate 150 single-sided pages per minute (ppm) or approximately 75 double-sided pages per minute with an appropriate duplexing technology. Small upgrades in system throughput may be achievable in robust printing systems. However, the doubling of throughput speed is mainly unachievable without a) purchasing a second reproduction apparatus with throughput identical to the first so that the two machines may be run in parallel, or without b) replacing the first reproduction apparatus with a radically redesigned print engine having double the speed. Both options are very expensive and often with regard to option (b), not possible.

Another option for increasing printing engine throughput is to utilize a second print engine in series with a first print engine. For example, U.S. Pat. No. 7,245,856 discloses a tandem print engine assembly which is configured to reduce image registration errors between a first side image formed by a first print engine, and a second side image formed by a second print engine. Each of the '856 print engines has a seamed photoreceptive belt. The seams of the photoreceptive belt in each print engine are synchronized by tracking a phase difference between seam signals from both belts. Synchronization of a slave print engine to a main print engine occurs once per revolution of the belts, as triggered by a belt seam signal, and the speed of the slave photoreceptor and the speed of an imager motor and polygon assembly are updated to match the speed of the master photoreceptor. Unfortunately, such a system tends to be susceptible to increasing registration errors during each successive image frame during the photoreceptor revolution. Furthermore, given the large inertia of the high-speed rotating polygon assembly, it is difficult to make significant adjustments to the speed of the polygon assembly in the relatively short time frame of a single photoreceptor revolution. This can limit the response of the '856 system on a per revolution basis, and make it even more difficult, if not impossible, to adjust on a more frequent basis.

In general, the timing offset of the first and second engines are determined by paper transport time from image transfer in the first engine to the image transfer in the second engine. If the sheet is inverted between the engines, the transport time can be a function of the receiver length. To compensate for varying receiver sheet sizes, one would either have to run the print engine assembly at a very high rate of speed to minimize the effects of receiver size. Alternatively, one can use the maximum size image frame for all receiver sizes. However, this would significantly reduce productivity.

Color images are made by printing separate images corresponding to an image of a specific color. The separate images are then transferred, in register, to the receiver. Alternatively, they can be transferred in register to a TIM and from the TIM to the receiver or they may be transferred separately to a TIM and then transferred and registered on the receiver. For example, a printing engine assembly capable of producing full color images may include at least four separate print engines or modules where each module or engine prints one color corresponding to the subtractive primary color cyan, magenta, yellow, and black. Additional development modules may include marking particles of additional colorants to expand the obtainable color gamut, clear toner, etc., as are known in the art. The quality of images produced on different print engines can be found to be objectionable if produced on different print engines even if the print engines are nominally the same, e.g. the same model produced by the same manufacturer. For example, the images can have slightly different sizes, densities or contrasts. These variations, even if small, can be quite noticeable if the images are compared closely.

In order to maximize productivity, different image frame sizes are utilized for different size receivers. Generally, the frame sizes are defined as preset portions of a primary imaging member in a printer such as equal portions that are from integral divisors of a primary imaging member (PIM), such as a photoreceptor, used in an electrophotographic engine. While this is often done to avoid a splice in a seemed PIM, it may be desirable for other reasons as well. For example, various process control algorithms may require that specific locations of a PIM be used solely for specific marks related to process control.

It is clearly important that certain image quality attributes, including size, print density, and contrast, match for prints made on separate print engines if those prints are subject to close scrutiny, as would be the case when a print made on a receiver sheet is produced on separate print engines. Specifically, the reflection density and the contrast of the prints need to closely match or the prints will be found to be objectionable to a customer. Even prints produced on two nominally identical digital printing presses such as electrophotographic printing presses described herein can vary in density and contrast due to variations in the photo-response of the PIM, variations in the charge or size of the marking particles, colorant dispersion variations within the batches of marking particles used in the separate engines, etc. It is clear that a method is needed to allow comparable prints to be produced on a plurality of engines.

SUMMARY OF THE INVENTION

This invention is a method and apparatus to synchronize a plurality of coupled electrophotographic engines in a manner so as to prevent buckling of receiver sheets. This is particularly suited for electrophotographic engines that are coupled together with an inverter that inverts the receiver sheet. Electrophotographic module can then print on the opposite side of the receiver sheet.

In one embodiment the second electrophotographic module, designated as E2, is started at a slower operating speed than its normal run speed. The PI control algorithm that controls the motor speed will then allow the speed of E2 to reach its nominal speed. Alternatively, two separate pulse counters can be used to monitor the control speeds of engines 1 (E1) and 2. Counter 2 starts on a frame pulse from E2 and stops on a frame pulse from E1. Conversely, counter 1 starts on a frame pulse from E1 and stops on a frame pulse from E2. Depending on which counter reports a real result, a new delay time would be calculated that would be added to or subtracted from the nominal delay time of E2.

Figure 1:
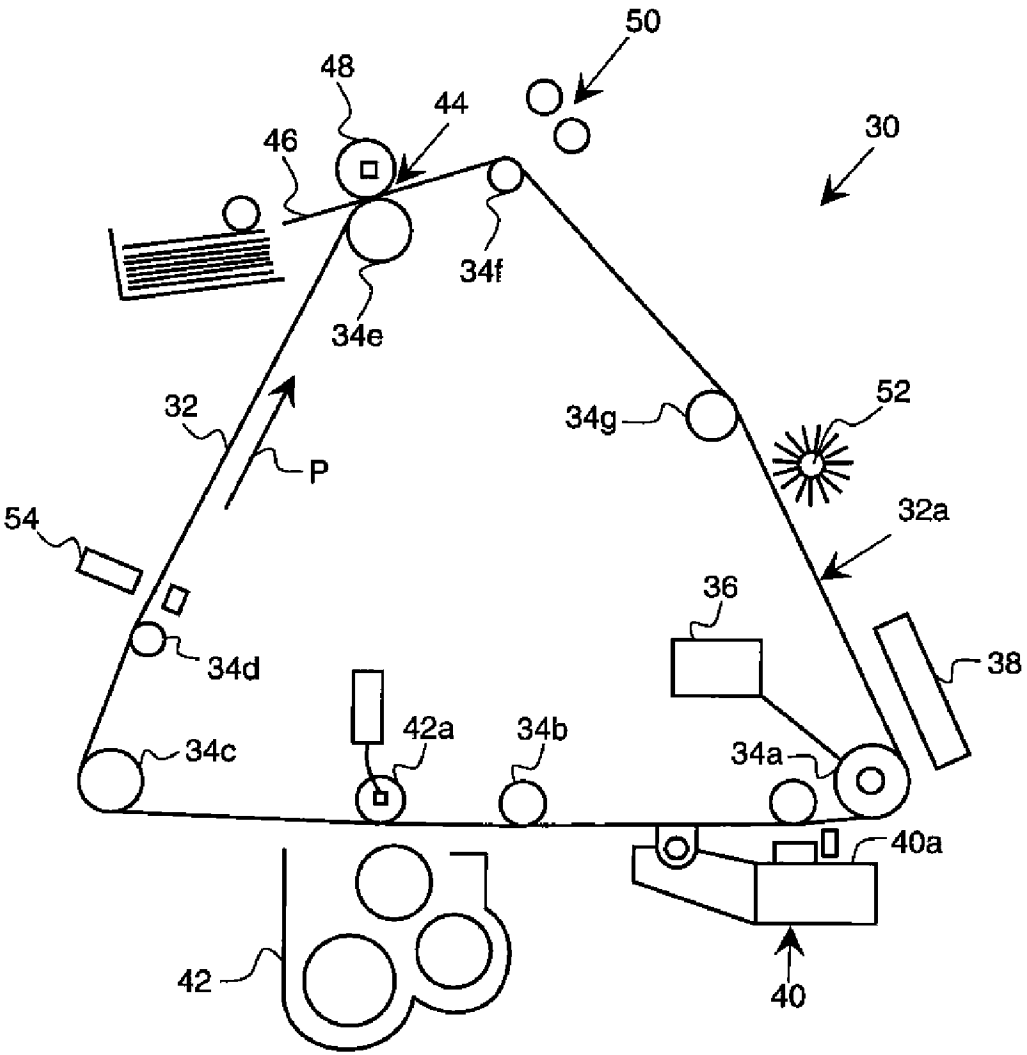
FIG. 1 schematically illustrates an embodiment of an electrophotographic print engine.

It will be appreciated that for purposes of clarity and where deemed appropriate, reference numerals have been repeated in the figures to indicate corresponding features, and that the various elements in the drawings have not necessarily been drawn to scale in order to better show the features.

DETAILED DESCRIPTION OF THE INVENTION

In order to maximize productivity, different image frame sizes are utilized for different size receivers. Generally, the frame sizes are defined as preset portions of a primary imaging member in a printer such as equal portions that are from integral divisors of a primary imaging member (PIM), such as a photoreceptor, used in an electrophotographic engine. While his is often done to avoid a splice in a seemed PIM, it may be desirable for other reasons as well. For example, various process control algorithms may require that specific locations of a PIM be used solely for specific marks related to process control.

Many applications in printing, especially digital printing and more particularly electrophotographic printing require that multiple print engines be sequentially ganged together to maximize printing efficiency. For example, as described in patent applications Ser. Nos. 12/126,192 and 12/126,267, an electrophotographic printer can comprise two similar print engines that have been coupled together. A module termed a productivity module inverts the receiver sheets, thereby allowing the production of duplex images to be formed on a receiver at the full process speed of an individual module, effectively doubling productivity.

To maximize printing efficiency and speed, the smallest frame size possible is generally chosen for a given size receiver. As described in patent applications Ser. Nos. 12/126,192 and 12/126,267, for coupled print engine configurations, the image frames for a slave print engine must be synchronized to those in the master print engine so that sheets are delivered from to the slave engine at the correct time for a specific image frame. As described in patent application Ser. No. 12/128,897, the image frames must also be delayed to allow for the time required for the receiver to travel from the image transfer location in one engine to the corresponding location in the second engine.

In some applications, as previously discussed, a digital print engine comprises two coupled printing modules separated by an inverter that flips the paper between the modules so that the second print engine forms a print on the reverse side of the receiver from that formed by the first print engine. For such applications, the inverter would have to transport the receiver at a high enough velocity to invert the longest receiver in the time normally allotted for inversion in the smallest image frame size mode if the same delay or temporal offset were used for all paper sizes. Because both the time to invert sheets and the time allotted for the corresponding image frames increase with receiver/image frame size, the optimum timing offset increases with image frame size. By intentionally defining different offsets for each frame mode, the inverter speed can be minimized without unduly compromising timing latitude. In other words, the timing latitude can be maximized for a given inverter speed.

In the case of an electrophotographic print engine assembly that includes a plurality of modules and/or print engines, speed mismatches between a module or engine that hands a receiver sheet to a subsequent module or engine can cause damage to either the receiver sheet or to the print engine assembly. Specifically, if a component, such as a fuser roller, etc. of the module or engine handing the receiver sheet is rotating at a slower speed than a component of the module or engine receiving the receiver sheet, the receiver will be pulled by the receiving module or engine. This can cause the receiver sheet to apply undesired and potentially damaging forces to the components of the modules or engines, can damage the receiver sheet, or at least degrade the image being printed. This invention addresses this problem by starting the receiving module or engine, hereafter referred to as engine 2, at a slightly slower speed than the donor engine or module, hereafter referred to as engine 1. Engine 2 is then allowed to match the speed of engine 1, as described in this invention.

The aforementioned patent applications disclose a method of synchronizing a slave print engine to a master by adjusting the appropriate print engine speed to achieve a consistent temporal offset between frame markers on the photoreceptors of the two print engines. According to these applications, the frame markers are physical markings such as perforations, splices, etc. If multiple frame modes are desired, it would be necessary to add additional markings for each frame of each mode. This is not desirable and, in some configurations such as when the PIM comprises a photoreceptive drum rather than a web, this is not even feasible. The timing marks can be marks printed on the PIM or transferred to a receiver. Alternatively, the marks can be generated signals controlled by a controller by sensing a location, such as a perforation, on the PIM. Thus these marks can be measured directly and be physical marks or be virtual marks that are actually electronic signals based on a location that can be determined using an encoder and the marks can be stored electronically in the engine control module.

In general, the timing offset of the first and second engines are determined by paper transport time from image transfer in the first engine to the image transfer in the second engine. If the sheet is inverted between the engines, the transport time can be a function of the receiver length. To compensate for varying receiver sheet sizes, one would either have to run the print engine assembly at a very high rate of speed to minimize the effects of receiver size. Alternatively, one can use the maximum size image frame for all receiver sizes. However, this would significantly reduce productivity.

The optimum timing offset that is described in this invention to allow synchronization is a function of the time required to transport the receiver from the image transfer location in the first print engine to that in the second print engine. As the timing offset can vary from printer to printer due to drive roller tolerances, the length or circumference of the photoreceptor, the paper path length, and engine to engine mating variations, it is necessary to provide a means to determine and set the required offset by a field engineer on the specific print engines. This is even more problematic when one is upgrading an existing single module print engine with a second print engine and, perhaps, even an inverter.

This invention describes a simple and direct method of achieving this synchronization using the optimum timing offset determined as described below. In this invention, the offset is set to a value corresponding to that for the smallest image frame size. Printing is initiated and the sheet arrival time is measured at a convenient point such as a registration or image transfer point. In order to minimize variability in this measurement, the sheets are directed in the non-invert path and the arrival time at the optical sensor in the Pre-Registration Assembly is measured relative to the slave engine image frame marker (F-Perf).

The average sheet arrival time for a number of sheets is compared to the target arrival time. The target arrival time is defined as the nominal arrival time, which is the arrival time that is expected to occur, of the lead edge of the receiver sheet at a specified location in a print engine such as the aforementioned optical sensor which is an actual sheet arrival time under normal operating conditions but may vary because of a number of variations such as feed slippage, the fuser make up, such as size, and writer conditions. Even small variations can have a large effect of the precise 0rinting at high speeds that is exhibited by the NexPress 300 and other higher speed high quality machines. A single arrival time is not accurate enough inmost of these conditions so it is substituted by an average the sheet arrival time that will be discussed below. The synchronization through the generated optimum timing offset is then adjusted accordingly so that the synchronization is optimized. By using the controller to calculate an average arrival time from actual sheet arrival times and an estimated location of one or more non-printable area in a particular set of conditions such as those discussed above and others that affect the printing quality and speed.

Because the vast majority of the timing variability that needs to be calibrated is common for all frame modes, this service program is only run for the most stringent frame mode and that correction is applied to all modes. In one embodiment of this invention that does not invert the sheets, it is suitable, not only for the case of coupled single color print engines separated by an inverter, but for other print engines such as color print engines whereby color prints corresponding to the separate colors comprising the finished print are produced on separate engines and registered either on an intermediate member or on the receiver.

FIG. 1 schematically illustrates an embodiment of an electrophotographic print engine 30. The print engine 30 has a movable recording member such as a photoreceptive belt 32, which is entrained about a plurality of rollers or other supports 34*a* through 34*g*. The photoreceptive belt 32 may be more generally referred-to as a primary imaging member (PIM) 32. A primary imaging member (PIM) 32 may be any charge carrying substrate which may be selectively charged or discharged by a variety of methods including, but not limited to corona charging/discharging, gated corona charging/discharging, charge roller charging/discharging, ion writer charging, light discharging, heat discharging, and time discharging.

One or more of the rollers 34*a*-34*g* are driven by a motor 36 to advance the PIM 32. Motor 36 preferably advances the PIM 32 at a high speed, such as 20 inches per second or higher, in the direction indicated by arrow P, past a series of workstations of the print engine 30, although other operating speeds may be used, depending on the embodiment. In some embodiments, PIM 32 may be wrapped and secured about a single drum. In further embodiments, PIM 32 may be coated onto or integral with a drum.

It is useful to define a few terms that are used in relation to this invention. Optical density is the log of the ratio of the intensity of the input illumination to the transmitted, reflected, or scattered light, or $D=\log(I_i/I_o)$ where D is the optical density, $I_i$ is the intensity of the input illumination, $I_o$ is the intensity of the output illumination, and log is the logarithm to the base 10. Thus, an optical density of 0.3 means that the output intensity is approximately half of the input intensity which is desirable for quality prints.

For some applications, it is preferable to measure the intensity of the light transmitted through a sample such as a printed image. This is referred to as the transmission density and is measured by first nulling out the density of the substrate supporting the image and then measuring the density of the chosen region of the image by illuminating the image through the back of the substrate with a known intensity of light and measuring the intensity of the light transmitted through the sample. The color of the light chosen corresponds to the color of the light principally absorbed by the sample. For example, if the sample consists of a printed black region, white light would be used. If the sample was printed using the subtractive primary colors (cyan, magenta, or yellow), red, green, or blue light, respectively, would be used.

Alternatively, it is sometimes preferable to measure the light reflected or scattered from a sample such as a printed image. This is referred to as the reflection density. This is accomplished by measuring the intensity of the light reflected from a sample such as a printed image after nulling out the reflection density of the support. The color of the light chosen corresponds to the color of the light principally absorbed by the sample. For example, if the sample consists of a printed black region, white light would be used. If the sample was printed using the subtractive primary colors (cyan, magenta, or yellow), cyan, magenta, or yellow light, respectively, would be used.

A suitable device for measuring optical density is an X-Rite densitometer with status A filters. Some such devices measure either transmission or reflected light. Other devices measure both transmission and/or reflection densities. Alternatively, for use within a printing engine, densitometers such as those described by Rushing in U.S. Pat. Nos. 6,567,171, 6,144,024, 6,222,176, 6,225,618, 6,229,972, 6,331,832, 6,671,052, and 6,791,485 are well suited. Other densitometers, as are known in the art, are also suitable.

The size of the sample area required for densitometry measurements varies, depending on a number of factors such as the size of the aperture of the densitometer and the information desired. For example, microdensitomers are used to measure site-to-site variations in density of an image on a very small scale to allow the granularity of an image to be measured by determining the standard deviation of the density of an area having a nominally uniform density. Alternatively, densitometers also are used having an aperture area of several square centimeters. These allow low frequency variations in density to be determined using a single measurement. This allows image mottle to be determined. For simple determinations of image density, the area to be measured generally has a radius of at least 1 mm but not more than 5 mm.

The term module means a device or subsystem designed to perform a specific task in producing a printed image. For example, a development module in an electrophotographic printer would include a primary imaging member (PIM) such as a photoreceptive member and one or more development stations that would image-wise deposit marking or toner particles onto an electrostatic latent image on the PIM, thereby rendering it into a visible image. A module can be an integral component in a print engine. For example, a development module is usually a component of a larger assembly that includes writing transfer and fuser modules such as are known in the art. Alternatively, a module can be self contained and can be made in a manner so that they are attached to other modules to produce a print engine. Examples of such modules include scanners, glossers, inverters that will invert a sheet of paper or other receiver to allow duplex printing, inserters that allow sheets such as covers or preprinted receivers to be inserted into documents being printed at specific locations within a stack of printed receiver sheets, and finishers that can fold, stable, glue, etc. the printed documents.

A print engine includes sufficient modules to produce prints. For example, a black and white electrophotographic print engine would generally include at least one development module, a writer module, and a fuser module. Scanner and finishing modules can also be included if called for by the intended applications.

A print engine assembly, also referred to in the literature as a reproduction apparatus, includes a plurality of print engines that have been integrally coupled together in a manner to allow them to print in a desired manner. For example, print engine assemblies that include two print engines and an inverter module that are coupled together to increase productivity by allowing the first print engine to print on one side of a receiver, the receiver then fed into the inverter module which inverts the receiver and feeds the receiver into the second print engine that prints on the inverse side of the receiver, thereby printing a duplex image.

A digital print engine is a print engine wherein the image is written using digital electronics. Such print engines allow the image to be manipulated, image by image, thereby allowing each image to be changed. In contrast, an offset press relies on the image being printed using press plates. Once the press plate is made, it cannot be changed. An example of a digital print engine is an electrophotographic print engine wherein the electrostatic latent image is formed on the PIM by exposing the PIM using a laser scanner or LED array. Conversely, an electrophotographic apparatus that relies on forming a latent image by using a flash exposure to copy an original document would not be considered a digital print engine.

A digital print engine assembly is a print engine assembly that a plurality of print engines of which at least one is a digital print engine.

Contrast is defined as the maximum value of the slope curve of the density versus log of the exposure. The contrast of two prints is considered to be equal if they differ by less than 0.2 ergs/cm$^2$ and preferably by less than 0.1 ergs/cm$^2$.

Print engine 30 may include a controller or logic and control unit (LCU) (not shown). The LCU may be a computer, microprocessor, application specific integrated circuit (ASIC), digital circuitry, analog circuitry, or a combination or plurality thereof. The controller (LCU) may be operated according to a stored program for actuating the workstations within print engine 30, effecting overall control of print engine 30 and its various subsystems. The LCU may also be programmed to provide closed-loop control of the print engine 30 in response to signals from various sensors and encoders. Aspects of process control are described in U.S. Pat. No. 6,121,986 incorporated herein by this reference.

A primary charging station 38 in print engine 30 sensitizes PIM 32 by applying a uniform electrostatic corona charge, from high-voltage charging wires at a predetermined primary voltage, to a surface 32*a* of PIM 32. The output of charging station 38 may be regulated by a programmable voltage controller (not shown), which may in turn be controlled by the LCU to adjust this primary voltage, for example by controlling the electrical potential of a grid and thus controlling movement of the corona charge. Other forms of chargers, including brush or roller chargers, may also be used.

An image writer, such as exposure station 40 in print engine 30, projects light from a writer 40*a* to PIM 32. This light selectively dissipates the electrostatic charge on photoreceptive PIM 32 to form a latent electrostatic image of the document to be copied or printed. Writer 40*a* is preferably constructed as an array of light emitting diodes (LEDs), or alternatively as another light source such as a Laser or spatial light modulator. Writer 40*a* exposes individual picture elements (pixels) of PIM 32 with light at a regulated intensity and exposure, in the manner described below. The exposing light discharges selected pixel locations of the photoreceptor, so that the pattern of localized voltages across the photoreceptor corresponds to the image to be printed. An image is a pattern of physical light, which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

After exposure, the portion of PIM 32 bearing the latent charge images travels to a development station 42. Development station 42 includes a magnetic brush in juxtaposition to the PIM 32. Magnetic brush development stations are well known in the art, and are desirable in many applications; alternatively, other known types of development stations or devices may be used. Plural development stations 42 may be provided for developing images in plural gray scales, colors, or from toners of different physical characteristics. Full process color electrographic printing is accomplished by utilizing this process for each of four toner colors (e.g., black, cyan, magenta, yellow).

Upon the imaged portion of PIM 32 reaching development station 42, the LCU selectively activates development station 42 to apply toner to PIM 32 by moving backup roller 42*a* and PIM 32, into engagement with or close proximity to the magnetic brush. Alternatively, the magnetic brush may be moved toward PIM 32 to selectively engage PIM 32. In either case, charged toner particles on the magnetic brush are selectively attracted to the latent image patterns present on PIM 32, developing those image patterns. As the exposed photoreceptor passes the developing station, toner is attracted to pixel locations of the photoreceptor and as a result, a pattern of toner corresponding to the image to be printed appears on the photoreceptor. As known in the art, conductor portions of development station 42, such as conductive applicator cylinders, are biased to act as electrodes. The electrodes are connected to a variable supply voltage, which is regulated by a programmable controller in response to the LCU, by way of which the development process is controlled.

Development station 42 may contain a two-component developer mix, which includes a dry mixture of toner and carrier particles. Typically the carrier preferably includes high coercivity (hard magnetic) ferrite particles. As a non-limiting example, the carrier particles may have a volume-weighted diameter of approximately 30μ. The dry toner particles are substantially smaller, on the order of 6μ to 15μ in volume-weighted diameter. Development station 42 may include an applicator having a rotatable magnetic core within a shell, which also may be rotatably driven by a motor or other suitable driving means. Relative rotation of the core and shell moves the developer through a development zone in the presence of an electrical field. In the course of development, the toner selectively electrostatically adheres to PIM 32 to develop the electrostatic images thereon and the carrier material remains at development station 42. As toner is depleted from the development station due to the development of the electrostatic image, additional toner may be periodically introduced by a toner auger (not shown) into development station 42 to be mixed with the carrier particles to maintain a uniform amount of development mixture. This development mixture is controlled in accordance with various development control processes. Single component developer stations, as well as conventional liquid toner development stations, may also be used.

A transfer station 44 in printing machine 10 moves a receiver sheet 46 into engagement with the PIM 32, in registration with a developed image to transfer the developed image to receiver sheet 46. Receiver sheets 46 may be plain or coated paper, plastic, or another medium capable of being handled by the print engine 30. Typically, transfer station 44 includes a charging device for electrostatically biasing movement of the toner particles from PIM 32 to receiver sheet 46. In this example, the biasing device is roller 48, which engages the back of sheet 46 and which may be connected to a programmable voltage controller that operates in a constant current mode during transfer. Alternatively, an intermediate member may have the image transferred to it and the image may then be transferred to receiver sheet 46. After transfer of the toner image to receiver sheet 46, sheet 46 is detacked from PIM 32 and transported to fuser station 50 where the image is fixed onto sheet 46, typically by the application of heat and/or pressure. Alternatively, the image may be fixed to sheet 46 at the time of transfer.

A cleaning station 52, such as a brush, blade, or web is also located beyond transfer station 44, and removes residual toner from PIM 32. A pre-clean charger (not shown) may be located before or at cleaning station 52 to assist in this cleaning. After cleaning, this portion of PIM 32 is then ready for recharging and re-exposure. Of course, other portions of PIM 32 are simultaneously located at the various workstations of print engine 30, so that the printing process may be carried out in a substantially continuous manner.

A controller provides overall control of the apparatus and its various subsystems with the assistance of one or more sensors, which may be used to gather control process, input data. One example of a sensor is belt position sensor 54.

Figure 2:
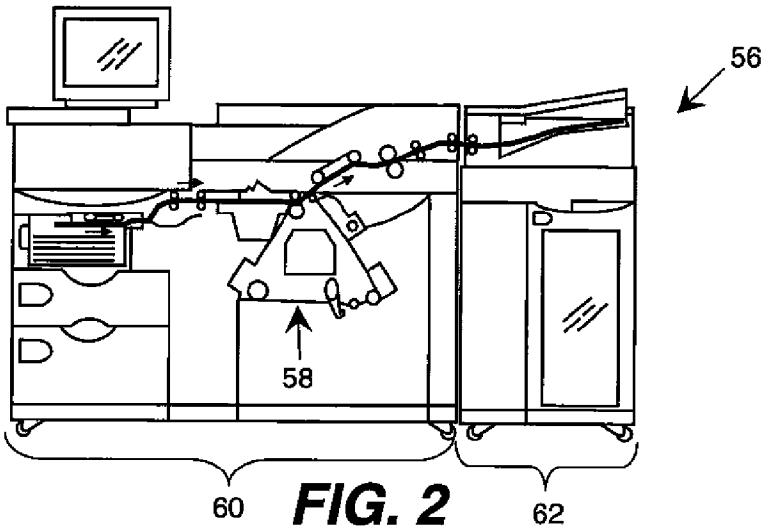
FIG. 2 schematically illustrates an embodiment of a reproduction apparatus having a first print engine.

FIG. 2 schematically illustrates an embodiment of a reproduction apparatus 56 having a first print engine 58 that is capable of printing one or a multiple of colors. The embodied reproduction apparatus will have a particular throughput, which may be measured in pages per minute (ppm). As explained above, it would be desirable to be able to significantly increase the throughput of such a reproduction apparatus 56 without having to purchase an entire second reproduction apparatus. It would also be desirable to increase the throughput of reproduction apparatus 56 without having to scrap apparatus 56 and replacing it with an entire new machine.

Quite often, reproduction apparatus 56 is made up of modular components. For example, the print engine 58 is housed within a main cabinet 60 that is coupled to a finishing unit 62. For simplicity, only a single finishing device 62 is shown, however, it should be understood that multiple finishing devices providing a variety of finishing functionality are known to those skilled in the art and may be used in place of a single finishing device. Depending on its configuration, the finishing device 62 may provide stapling, hole punching, trimming, cutting, slicing, stacking, paper insertion, collation, sorting, and binding.

Figure 3A:
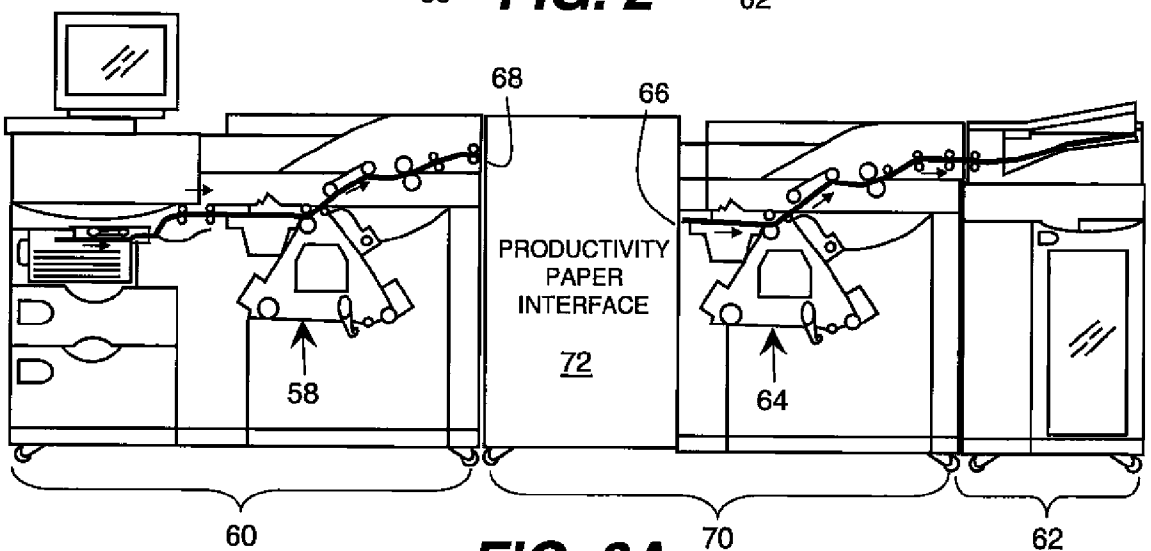
FIGS. 3A-3C schematically illustrate embodiments of a reproduction apparatus having a first print engine and a tandem second print engine from a productivity module.
Figure 3B:
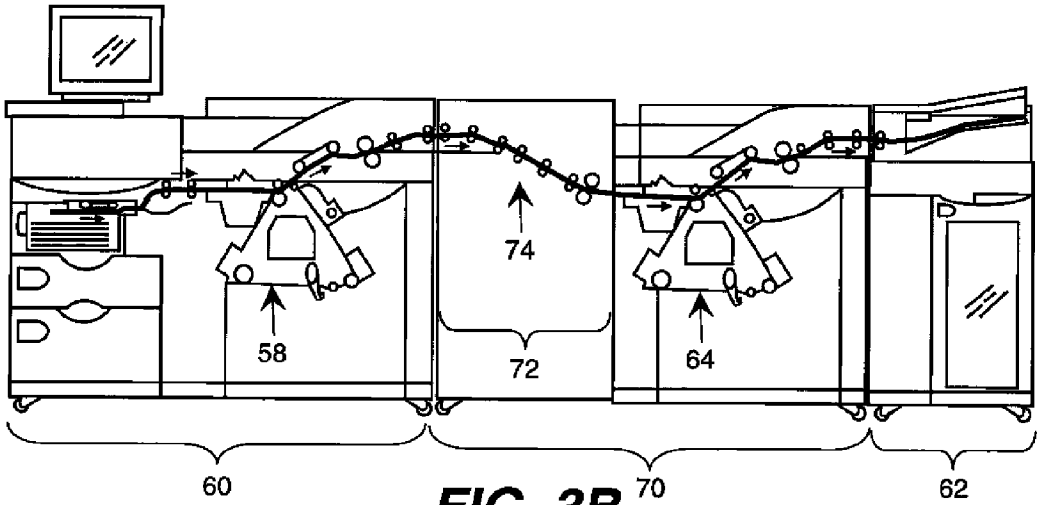
Figure 3C:
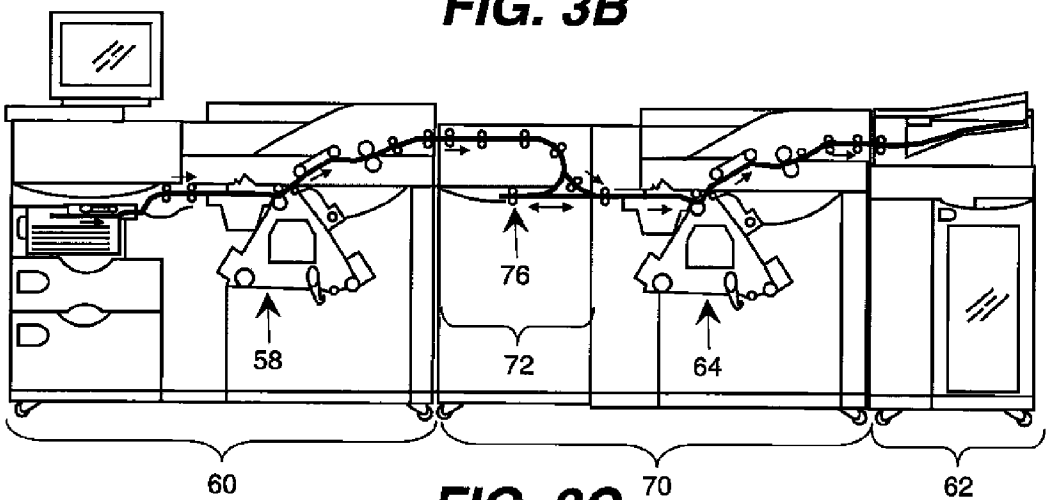

As FIG. 3A schematically illustrates, a second print engine 64 may be inserted in-line with the first print engine 58 and in-between the first print engine 58 and the finishing device 62 formerly coupled to the first print engine 58. The second print engine 64 may have an input paper path point 66 which does not align with the output paper path point 68 from the first print engine 58. Additionally, or optionally, it may be desirable to invert the receiver sheets from the first print engine 58 prior to running them through the second print engine (in the case of duplex prints). In such instances, the productivity module 70 which is inserted between the first print engine 58 and the at least one finisher 62 may have a productivity paper interface 72. Some embodiments of a productivity paper interface 72 may provide for matching 74 of differing output and input paper heights, as illustrated in the embodiment of FIG. 3B. Other embodiments of a productivity paper interface 72 may provide for inversion 76 of receiver sheets, as illustrated in the embodiment of FIG. 3C.

Providing users with the option to re-use their existing equipment by inserting a productivity module 70 between their first print engine 58 and their one or more finishing devices 62 can be economically attractive since the second print engine 64 of the productivity module 70 does not need to come equipped with the input paper handling drawers coupled to the first print engine 58. Furthermore, the second print engine 64 can be based on the existing technology of the first print engine 58 with control modifications which will be described in more detail below to facilitate synchronization between the first and second print engines.

Figure 4:
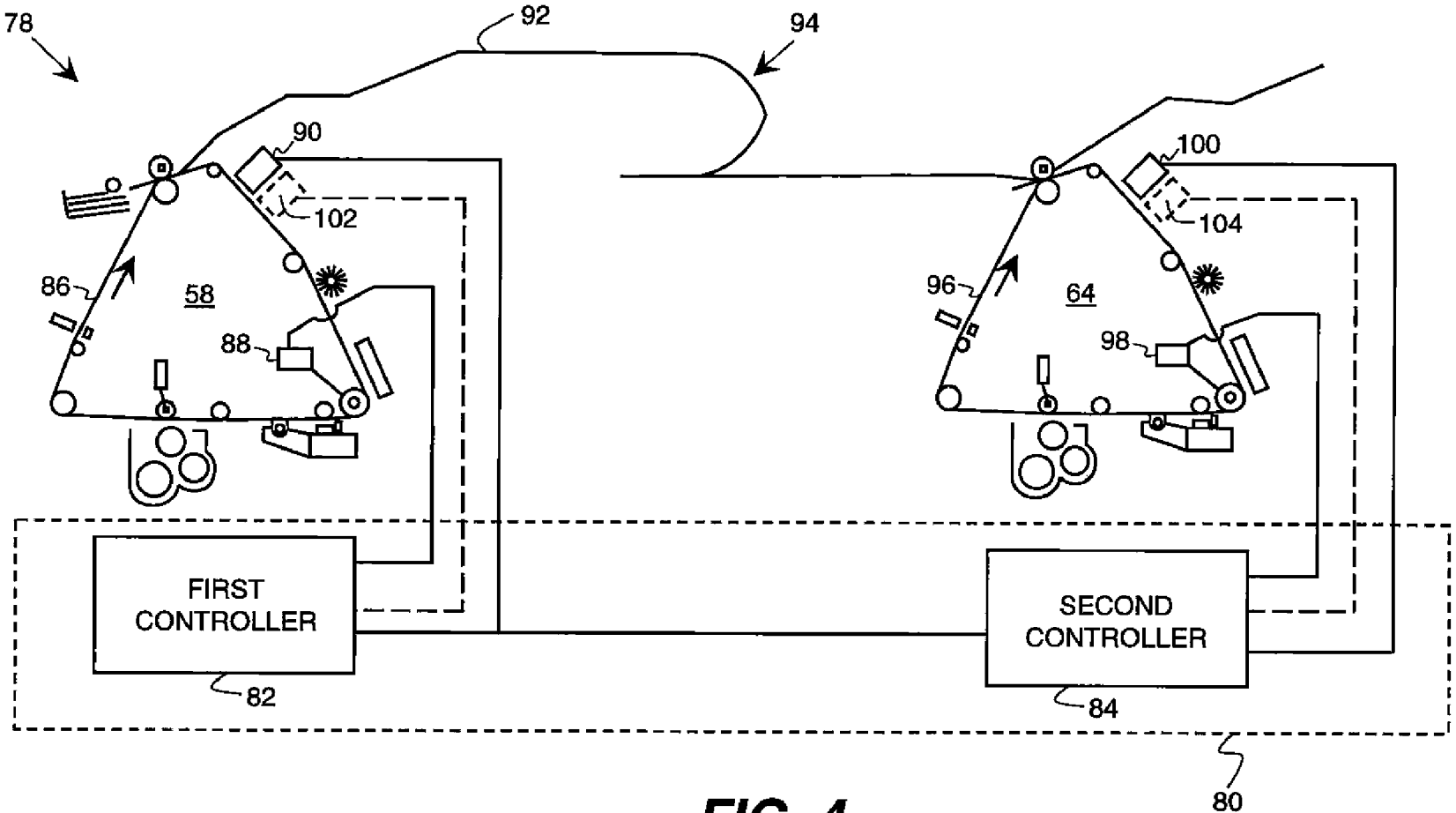
FIG. 4 schematically illustrates an embodiment of a reproduction or printing apparatus having embodiments of a first and second print engines.

FIG. 4 schematically illustrates an embodiment of a reproduction apparatus 78 having embodiments of first and second print engines 58, 64 which are synchronized by a controller 80. Controller 80 may be a computer, a microprocessor, an application specific integrated circuit, digital circuitry, analog circuitry, or any combination and/or plurality thereof. In this embodiment, the controller 80 includes a first controller 82 and a second controller 84. Optionally, in other embodiments, the controller 80 could be a single controller as indicated by the dashed line for controller 80. The first print engine 58 has a first primary imaging member (PIM) 86, the features of which have been discussed above with regard to the PIM of FIG. 1. The first PIM 86 also preferably has a plurality of frame markers corresponding to a plurality of frames on the PIM 86. In some embodiments, the frame markers may be holes or perforations in the PIM 86 which an optical sensor can detect.

The frame markers may be reflective or diffuse areas on the PIM, which an optical sensor can detect. Other types of frame markers will be apparent to those skilled in the art and are intended to be included within the scope of this specification. The first print engine 58 also has a first motor 88 coupled to the first PIM 86 for moving the first PIM when enabled. As used here, the term "enabled" refers to embodiments where the first motor 88 may be dialed in to one or more desired speeds as opposed to just an on/off operation. Other embodiments, however, may selectively enable the first motor 88 in an on/off fashion or in a pulse-width-modulation fashion.

The first controller 82 is coupled to the first motor 88 and is configured to selectively enable the first motor 88 (for example, by setting the motor for a desired speed, by turning the motor on, and/or by pulse-width-modulating an input to the motor). A first frame sensor 90 is also coupled to the first controller 82 and configured to provide a first frame signal, based on the first PIM's plurality of frame markers, to the first controller 82.

A second print engine 64 is coupled to the first print engine 58, in this embodiment, by a paper path 92 having an inverter 94. The second print engine 64 has a second primary imaging member (PIM) 96, the features of which have been discussed above with regard to the PIM of FIG. 1. The second PIM 96 also preferably has a plurality of frame markers corresponding to a plurality of frames on the PIM 96. In some embodiments, the frame markers may be holes or perforations in the PIM 96, which an optical sensor can detect. In other embodiments, the frame markers may be reflective or diffuse areas on the PIM which an optical sensor can detect. Other types of frame markers will be apparent to those skilled in the art and are intended to be included within the scope of this specification. The second print engine 64 also has a second motor 98 coupled to the second PIM 96 for moving the second PIM 96 when enabled. As used here, the term "enabled" refers to embodiments where the second motor 98 may be dialed in to one or more desired speeds as opposed to just an on/off operation. Other embodiments, however, may selectively enable the second motor 98 in a pulse-width-modulation fashion.

The second controller 84 is coupled to the second motor 98 and is configured to selectively enable the second motor 98 (for example, by setting the motor for a desired speed, or by pulse-width-modulating an input to the motor). A second frame sensor 100 is also coupled to the second controller 84 and configured to provide a second frame signal, based on the second PIM's plurality of frame markers, to the second controller 84. The second controller 84 is also coupled to the first frame sensor 90 either directly as illustrated or indirectly via the first controller 82 which may be configured to pass data from the first frame sensor 90 to the second controller 84.

Figure 5:
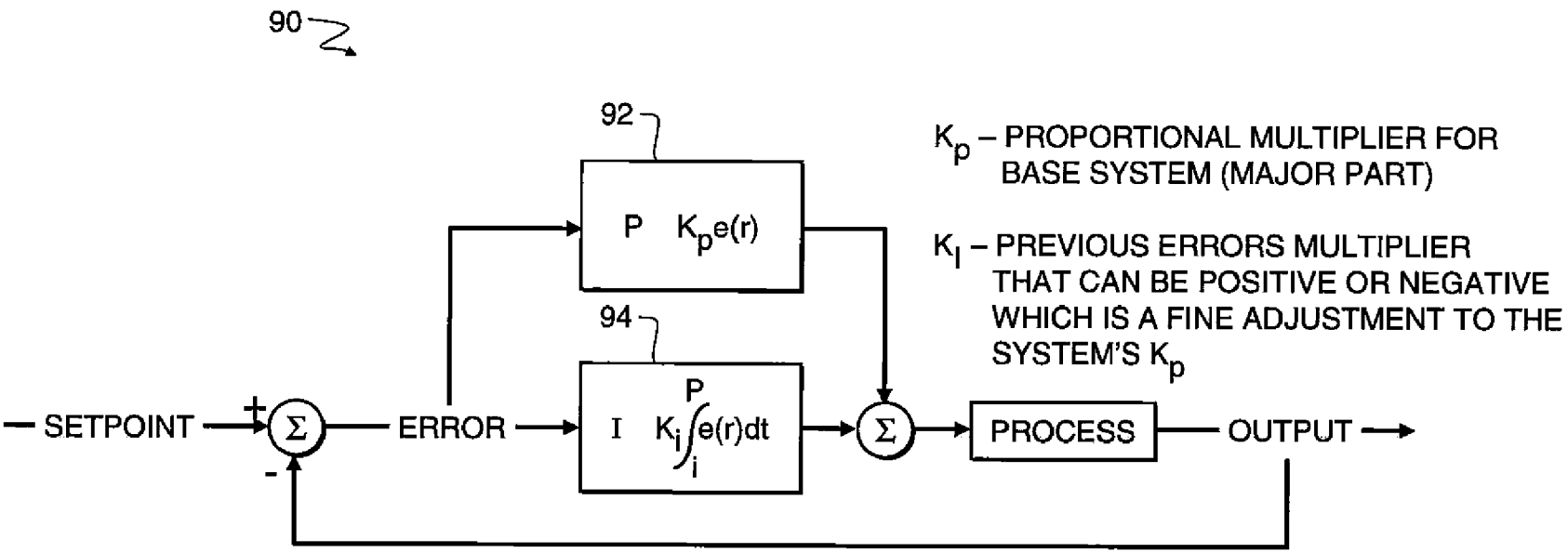
FIG. 5 schematically illustrates a PI algorithm as used in the present invention.

FIG. 5 shows a schematic of how a PI algorithm is used in the present invention. The Proportional integral (PI) algorithm 90 is a control algorithm that controls printer speed. Other similar algorithms could be substituted if they worked in a similar manner. In one embodiment the PI control algorithm controls the motor using the position and outputting a parameter such as position. The Proportional integral (PI) looks at an error and integrates the error to give sum total of errors as shown in FIG. 5 and further described here. The PI algorithm embodiment in FIG. 5 has two parts, a proportional major part 92 that acts as the main printer control and a smaller fine adjustment 94 for delta time changes. The Proportional value (P) uses a delta time (Dt) from the counters and multiplies this delta time by a simple constant proportional term (Kp) that is related to the printer system. This term can be obtained emphatically from the hardware system or calculated theoretically and represents the printer system basic hardware response (i.e. it is gain value). This Kp is multiplied by e(r) which represents a delta time value. Besides calculating the proportional basic part, a correction must be made for the additional variances that occur over time referred to as the integral value 94. These are changes can occur if the speed of any of the several modules varies, as can occur due to torque disturbances, power line voltage or frequency variations, etc and effect the system accuracy including the synchronization of the system's engines. The integral value 94 acts as an integrator and takes and sums these various errors and multiplies by an integral gain value (Ki) which is obtained emphatically from the hardware system or calculated theoretically and represents the printer system basic hardware response. Then the proportional value (P) and the integral value (I) outputs are summed up and the summation sent to the motor controller to make an adjustment that drives the system to synchronization. The adjustment can control motor velocities thus adjusting the engine speeds as is discussed in more detail below.

Figure 6:
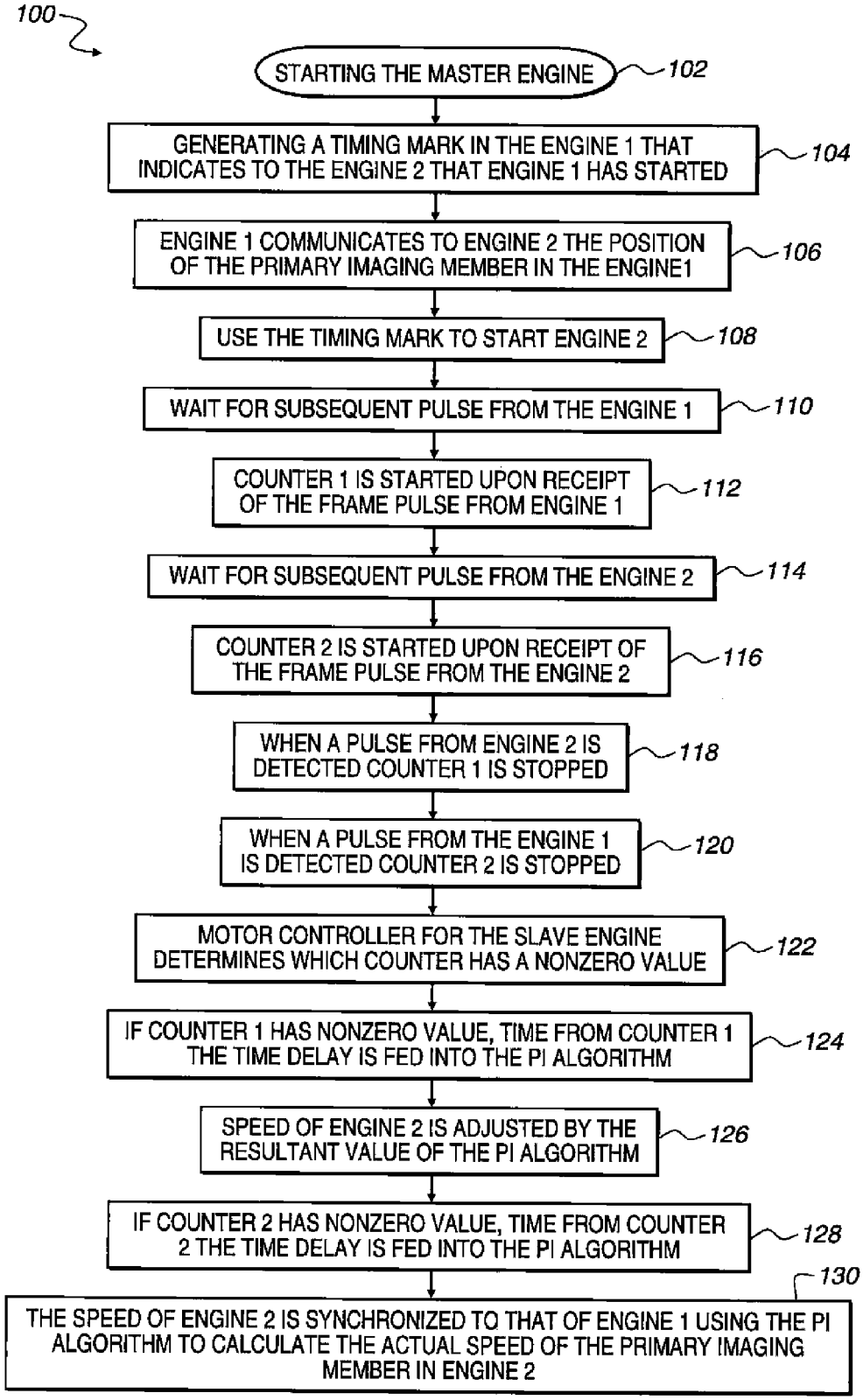
FIG. 6 is a flow chart illustrating an embodiment of the present invention.

FIG. 6 shows a schematic of how the present invention operates in a preferred mode of operation comprising two print engines, such as two black and white engines, coupled to each other through an inverter. This flowchart 100 shows starting the master engine 102, generating a timing mark in the engine 1 that indicates to the engine 2 that engine 1 has started 104. Note that this master engine could control more then one coupled engine by cascading the controls to each subsequent engine as described. Then engine 1 communicates to engine 2 the position of the primary imaging member in the engine 1-106, using the timing mark to start engine 2-108, waiting for subsequent pulse from the engine 1-110, then counter 1 is started upon receipt of the frame pulse from engine 1-112, then waiting for the subsequent pulse from the engine 2-114, then a counter 2 is started upon receipt of the frame pulse from the engine 2-116. When a pulse from engine 2 is detected counter 1 is stopped 118 and when a pulse from the engine 1 is detected counter 2 is stopped 120. The motor controller for the slave engine determines which counter has a nonzero value 122. If counter 1 has nonzero value, time from counter 1 the time delay is fed into the PI algorithm 124. The speed of engine 2 is adjusted by the resultant value of the PI algorithm 126. If counter 2 has nonzero value, time from counter 2 the time delay is fed into the PI algorithm 128. The speed of engine 2 is synchronized to that of engine 1 using the PI algorithm to calculate the actual speed of the primary imaging member in engine 2-130.

Figure 7:
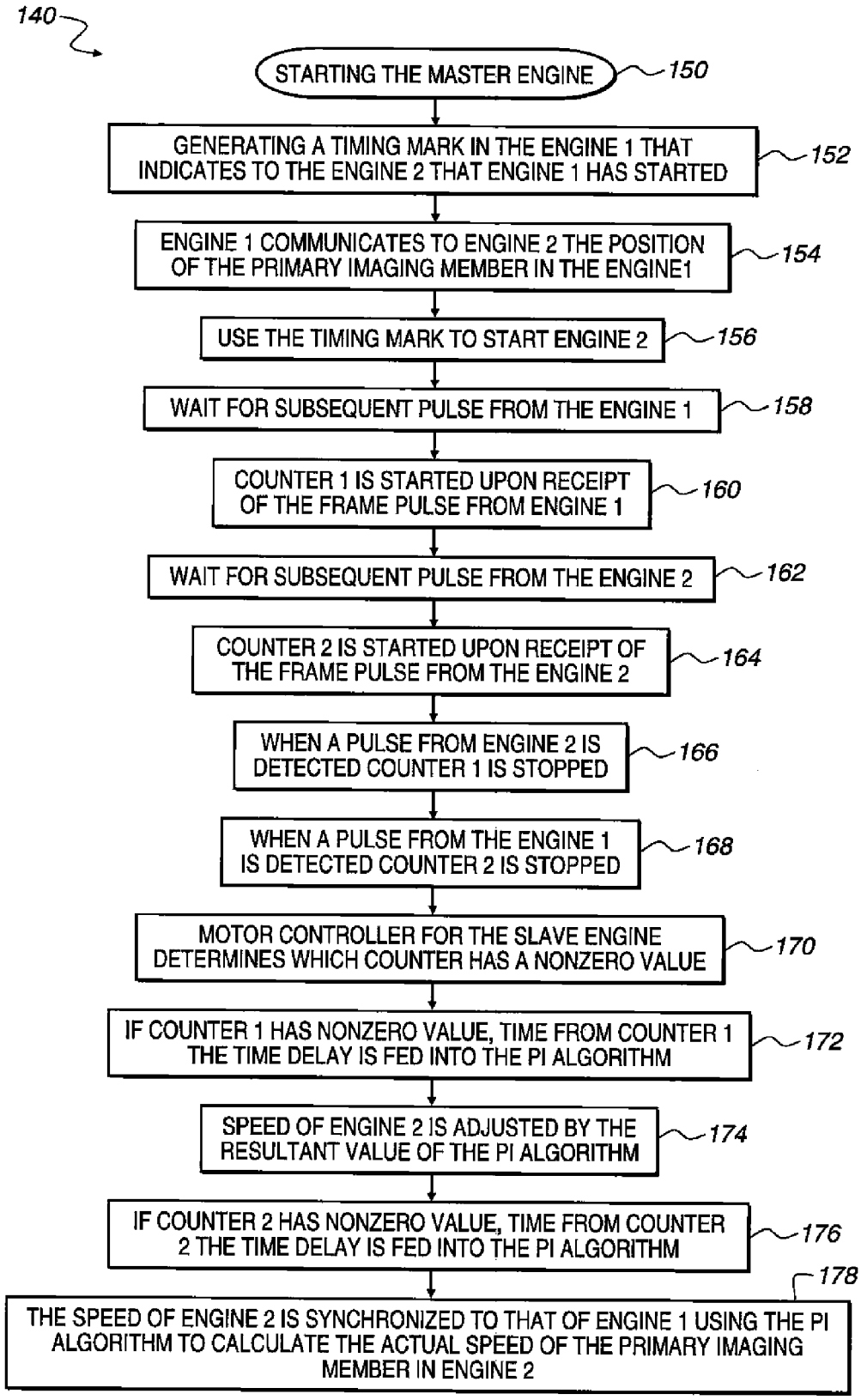
FIG. 7 is a flow chart illustrating another embodiment of the present invention.

FIG. 7 shows a flow chart depicting an alternative preferred embodiment of practicing this invention. In this embodiment, A method 140 for synchronizing a plurality of coupled electrophotographic engines whereby engine 1 serves as a master and engine 2 serves as a slave including starting a master engine 150 and generating a timing mark in the engine 1 that indicates to the engine 2 that engine 1 has started 152. Then engine 1 communicates to engine 2 the position of the primary imaging member in the engine 1-154 and the timing mark is used to start engine 2 156. The printer then waits for a subsequent pulse from the engine 1-158 and a counter 1 is started upon receipt of the frame pulse from engine 1-160. The printer then waits for a subsequent pulse from the engine 2-162 and a counter 2 is started upon receipt of the frame pulse from the engine 2-164. When a pulse from engine 2 is detected counter 1 is stopped 166 and when a pulse from the engine 1 is detected counter 2 is stopped 168.

The motor controller for the slave engine (engine 2) must determine which counter has a nonzero value 170 or in another way identify which counter controls so the corrections are made to the speed of the correct engine and if counter 1 has nonzero value, time from counter 1 the time delay is fed into the PI algorithm 172 and the speed of engine 2 is adjusted by the resultant value of the PI algorithm 174. Alternatively if counter 2 has nonzero value, time from counter 2 the time delay is fed into the PI algorithm 176 and the speed of engine 2 is synchronized to that of engine 1 using the PI algorithm to calculate the actual speed of the primary imaging member in engine 2-178. It is not only necessary to have the two or more counters but the PI algorithm must know which counter saw what so the appropriate correction is done as shown in the one example above. For example, in a simplified example, if the first engine is ahead then the second engine is be sped up and if the second engine is ahead and that counter show an adjustment is needed then the appropriate adjustment is made to that engine to synchronize that engine to the first engine. In a simplified example, if the first engine is ahead then the second engine is sped up and if the second engine is ahead and that counter show an adjustment is needed then the appropriate adjustment is made to that engine to synchronize that engine to the first engine.

While the operation of each individual print engine 58 and 64 has been described on its own, the second controller 84 is also configured to synchronize the first and second print engines 58, 64 on a frame-by-frame basis. Optionally, the second controller 84 may also be configured to synchronize a first PIM splice seam from the first PIM 86 with a second PIM splice seam from the second PIM 96. In the embodiments that synchronize the PIM splice seams, the first print engine 58 may have a first splice sensor 102 and the second print engine 64 may have a second splice sensor 104. In other embodiments, the frame sensors 90, 100 may be configured to double as splice sensors.

It should be noted that in a series of copending patent applications, the terms "slave engine" or "slave module" and "master engine" or "master module" are used to designate the engine that is driven by or drives another engine in an electrophotographic print engine comprising a plurality of coupled digital print engines or modules, respectively, through its control system. The master engine can be either before or after a slave engine. However, in this application, the terms "engine or module 1 (E1)" and "engine or module 2 (E2) designate the engine that feeds and receives a receiver sheet from the other, respectively.

While the disclosure focuses on the best mode of practice featuring coupled digital print engines comprising photoreceptive primary imagine members, it is clear that any other coupled digital print engine comprising a primary imaging member and whereby the image is transferred from the primary imaging member to a receiver such as paper within each print module which comprise the coupled digital print engine can also use this invention.

Further definitions used in this patent:

Frame pulse: MTB (machine timing bus) defines frame on the primary imaging member. This tells the controller (LCU) the precise location of the frame. The term proportional integral (PI) receives each timing error and sums the errors to give total timing error. The control algorithm is a PI algorithm that controls the motor using the position feedback as discussed above in conjunction to FIG. 5.

In one preferred mode of practicing this invention, the second engine is started at a slower velocity than that required for normal running. This creates a larger time delay between a position pulse from and allow the PI control algorithm to drive the delta T back into range. A short coming with this approach is that if the delta T remains larger than the target value for too long, this will generate an error, as well as lengthen the first copy time. A dynamic limit was added to overcome the time to sync resulting from the slower than planed velocity of E2 initially. The dynamic limit allows for a larger delta T for a programmable number of film revolutions, before invoking the required limit.

In practicing this mode of the invention, only one timing counter is needed. This preferred mode of the invention is practiced by:

Starting the engine 1;

Generating a timing mark in engine 1 that indicates to 2 engine that the engine 1 has started;

Engine 1 communicates to engine 2 the position of the primary imaging member in engine 1;

The timing mark to start the engine 2 at a slower speed than required for printing;

A second timing pulse is generated by engine 1:

A timing counter is started upon receipt of the second pulse from engine 1;

A first pulse is generated from engine 2;

When first pulse from engine 2 is detected, the counter is stopped;

The time from between the first pulse from engine 2 and the second pulse from engine 1 is fed into the PI algorithm;

The speed of engine 2 is synchronized to that of engine 1 using the PI algorithm to calculate the actual speed of the primary imaging member in engine 2.

In one preferred mode of this invention, the primary imaging member is a photoreceptive member. It is also desirable to increase the allowable time delay upon start up to avoid generating an error message and shutting down the coupled digital print engine.

In a second preferred embodiment of this invention, two timing counters are used. Digital print engine 1 serves as the master and digital print engine 2 serves as the slave. According to this mode of practice, start and stop pulses are fed into each of two counters. If a counter receives a stop pulse before it receives a start pulse, the counter never starts and stores a null value. If the counter starts and is then stopped, it stores a positive value representative of the time delay between pulses in the first and second digital print engines. This mode of practicing the invention is as follows:

Starting the master engine;

Generating a timing mark in the engine 1 that indicates to the engine 2 that engine 1 has started;

Engine 1 communicates to engine 2 the position of the primary imaging member in the engine 1;

Use the timing mark to start engine 2;

Wait for subsequent pulse from the engine 1;

Counter 1 is started upon receipt of the frame pulse from engine 1;

Wait for subsequent pulse from the engine 2;

Counter 2 is started upon receipt of the frame pulse from the engine 2;

When a pulse from engine 2 is detected counter 1 is stopped;

When a pulse from the engine 1 is detected counter 2 is stopped;

Motor controller for the slave engine determines which counter has a nonzero value;

If counter 1 has nonzero value, time from counter 1 the time delay is fed into the PI algorithm;

Speed of engine 2 is adjusted by the resultant value of the PI algorithm;

If counter 2 has nonzero value, time from counter 2 the time delay is fed into the PI algorithm;

The speed of engine 2 is synchronized to that of engine 1 using the PI algorithm to calculate the actual speed of the primary imaging member in engine 2.

If the digital print engine comprises more than two digital print modules, the roles of engines 1 and 2 sequentially shift. For example, if there are three coupled digital print modules, after engine 2 has started and it running at the proper speed, it assumes the role of engine 1 and engine 3 assumes the role of engine 2.

The invention has been described in detail with particular reference to certain preferred embodiments thereof, but it will be understood that variations and modifications can be effected within the spirit and scope of the invention.

What is claimed is:

1. A method of synchronizing a plurality of coupled electrophotographic engines whereby engine 1 serves as a master and engine 2 serves as a slave, the method comprising:

starting an engine 1;

generating a timing mark in the engine 1 that indicates to an engine 2 that the engine 1 has started and communicating to engine 2 a timing mark indicating a position of a primary imaging member in engine 1 such that the timing mark allows the engine 2 to start at a slower speed than required for printing;

generating a timing pulse by engine 1 and starting a timing counter upon receipt of the timing pulse from engine 1;

generating a pulse from engine 2 and stopping the counter when the pulse from engine 2 is detected;

calculating a delta time between the pulse from engine 2 and the timing pulse from engine 1;

using a correction algorithm and the delta time calculated to calculate an actual speed for the primary imaging member in engine 2 that allows the engine 2 to be synchronized with engine 1.

2. The method according to claim 1 whereby the correction algorithm is a Proportional Integral algorithm.

3. The method according to claim 1 whereby the first engine speed and the second engine speed is measured relative to a frame pulse.

4. The method according to claim 1 further comprising calculating a delta time at a scheduled event in a printer cycle.

5. The method according to claim 4 wherein that event is after an initial number of rotations of the primary imaging member after an initial start up.

6. The method according to claim 4 wherein the event is programmable based on a range of values.

7. The method according to claim 1 wherein the correction algorithm step uses between 2 and 10 determinations.

8. The method according to claim 1 whereby the delta time is calculated over a number of sequential frames less than 10.

9. A method of synchronizing a plurality of coupled electrophotographic engines whereby engine 1 serves as a master and engine 2 serves as a slave comprising:

starting an engine 1;

generating a timing mark in the engine 1 that indicates to an engine 2 that the engine 1 has started and communicating to engine 2 a timing mark indicating a position of a primary imaging member in engine 1 such that the timing mark allows the engine 2 to start;

generating a timing pulse from engine 1 and starting a timing counter 1 upon receipt of the timing pulse from engine 1;

generating a pulse from engine 2 and starting a timing counter 2 upon receipt of the pulse from engine 2;

stopping the counter 1 when a first pulse from engine 2 is detected and stopping the counter 2 when a first pulse from engine 1 is detected;

generating a signal from one of timing counter 1 and timing counter 2 feeding data to a correction algorithm along with information indicating a timing counter identity so that a speed of engine 2 is adjusted by a resultant value from the correction algorithm to synchronize engine 2 to engine 1 using a new calculated speed.

10. The method according to claim 9 whereby the correction algorithm is a Proportional Integral algorithm using a delta time calculated to calculate an actual speed for the primary imaging member in engine 2 that allows the engine 2 to be synchronized with engine 1.

11. The method according to claim 10 whereby the first counter is an indication that the associated engine is ahead of the other engine and the algorithm corrects for that using the engine indicator and the first counter data.

12. The method according to claim 11 further comprising correcting consecutive engines by repeating the method as a cascade through all the engines.

13. The method according to claim 10 wherein the corrections are done in small increments.

14. The method according to claim 10 whereby the first engine speed and the second engine speed is measured relative to a frame pulse.

15. The method according to claim 10 further comprising starting the correction algorithm at a scheduled event in a printer cycle.

16. The method according to claim 15 wherein that event is after an initial number of rotations of a primary imaging member after an initial start up.

17. The method according to claim 15 wherein the event is programmable based on a range of values.

18. The method according to claim 10 whereby the synchronization method is shut down.

* * * * *